US005454500A

United States Patent [19]

Chen

[11] Patent Number: 5,454,500

[45] Date of Patent: Oct. 3, 1995

[54] TOILET-PAPER HOLDER

[75] Inventor: Cheng-Chang Chen, Taipei, Taiwan

[73] Assignee: Cheng-Feng Chen, Taiwan, Prov. of China

[21] Appl. No.: 271,066

[22] Filed: Jul. 5, 1994

[51] Int. Cl.[6] ..... B26F 3/02; B65H 16/10

[52] U.S. Cl. ..... 225/46; 225/47; 242/545; 242/564; 242/597.5; 242/597.6; 206/403

[58] Field of Search ..... 225/16, 10, 11, 225/14, 42, 47; 206/403, 405, 406, 407; 242/545, 564, 597.5, 597.6, 394

[56] References Cited

U.S. PATENT DOCUMENTS

| | | | |
|---|---|---|---|
| D. 348,579 | 7/1994 | Brandenburg | D6/523 |
| 427,407 | 5/1890 | Donovan | 225/14 |
| 1,415,722 | 5/1922 | Silverman | 225/47 |
| 2,518,934 | 8/1950 | Renner et al. | 242/394 |
| 3,258,216 | 6/1966 | Wren | 242/564 |
| 3,311,319 | 3/1967 | Campbell | 242/394 |
| 3,317,150 | 5/1967 | Summersby | 242/564 |
| 4,069,958 | 1/1978 | Strauss | 225/16 |
| 5,058,792 | 10/1991 | Morand | 225/42 |
| 5,065,924 | 11/1991 | Granger | 225/42 |
| 5,180,090 | 1/1993 | Douglas et al. | 225/42 |

FOREIGN PATENT DOCUMENTS

| | | | |
|---|---|---|---|
| 154066 | 5/1952 | Australia | 225/11 |

*Primary Examiner*—Rinaldi I. Rada
*Assistant Examiner*—Charles Goodman
*Attorney, Agent, or Firm*—Ladas & Parry

[57] ABSTRACT

A toilet-paper holder has a casing with a pan. The pan has a base, a peripheral wall extending from the base and an open end. The peripheral wall has an exit opening. The casing further has a cover which is pivoted to the pan and which covers openably the open end of the pan. The cover has a base wall opposite to the base of the pan. A stationary shaft is provided in the casing and has a first end fixed to the base of the pan and a second end extending toward the base wall of the cover. A sleeve member is mounted coaxially and rotatably to the stationary shaft and has an end which extends toward the base wall of the cover. A rotary knob is mounted movably on the base wall of the cover and is operable to rotate the sleeve member. The rotary knob extends inwardly of the cover and is movable axially between an engaging position, wherein the rotary knob engages releasably the sleeve member in order to rotate the sleeve member, and a releasing position, wherein the rotary knob is released from the sleeve member in order to permit free rotation of the sleeve member.

17 Claims, 6 Drawing Sheets

TOILET-PAPER HOLDER

BACKGROUND OF THE INVENTION

1. Field of the Invention

This invention relates to a toilet-paper holder, particular to an improved toilet-paper holder in which a toilet-paper roll can be received lockably in a casing and in which a distal end of the toilet-paper roll can be easily extended from the casing even when the distal end is concealed in the latter.

2. Description of the Related Art

Referring to FIG. 1, a first example of a conventional toilet-paper holder 100 is shown to include a base frame 10, a cover 11 and a roller 12 which is mounted rotatably on the base frame 10 in order to hold a toilet-paper roll (not shown) thereon. In the conventional holder 100, it is inconvenient to reel an excess length of paper backwards after unreeling the paper for use. Another drawback of the toilet-paper holder 100 is that the toilet-paper roll can be easily stolen.

Referring to FIG. 2, a second example of a conventional toilet-paper holder 200 is shown to include a casing 20 which has a cover 21 and which is provided with a locking means 210. A toilet-paper roll is received lockably in the casing 20, and a predetermined length of paper can be obtained by pulling a distal end of the paper outwards. Since the toilet-paper roll is received lockably in the casing 20, stealing of the former can be prevented. A main drawback of the toilet-paper holder 200 is that it is difficult to unreel the paper when the distal end of the paper is concealed in the casing 20. Another drawback is that it is difficult to reel an excess length of paper backwards after unreeling the paper for use.

SUMMARY OF THE INVENTION

The objective of this invention is to provide an improved toilet-paper holder in which a toilet-paper roll can be received lockably in a casing, in which a distal end of the toilet-paper roll can be easily extended from the casing even when the distal end is concealed in the latter, and in which an excess length of paper can be conveniently reeled backwards after unreeling the paper for use.

A toilet-paper holder according to this invention has a casing with a pan. The pan has a base, a peripheral wall extending from the base, and an open end. The peripheral wall has an exit opening. The casing further has a cover which is pivoted to the pan and which covers openably the open end of the pan. The cover has a base wall opposite to the base of the pan. A stationary shaft is provided in the casing and has a first end fixed to the base of the pan and a second end extending toward the base wall of the cover. A sleeve member is mounted coaxially and rotatably to the stationary shaft and has one end which extends toward the base wall of the cover and which may be formed with angularly spaced and axially projecting clutch teeth. A rotary knob is mounted movably on the base wall of the cover and is operable so as to rotate the sleeve member. The rotary knob extends inwardly of the cover and is movable axially between an engaging position, wherein the rotary knob engages releasably the sleeve member in order to rotate the sleeve member, and a releasing position, wherein the rotary knob is released from the sleeve member in order to permit free rotation of the sleeve member.

The peripheral wall of the pan has two opposite edges which define the exit opening and two toothed cutting plates mounted respectively to the two opposite edges. The cover has a peripheral wall which extends from the base wall to be coupled detachably with the peripheral wall of the pan. The peripheral wall of the cover has an exit opening aligned with the exit opening of the peripheral wall of the pan. The peripheral wall of the cover has two opposite edges which define the exit opening thereof and two flanges which extend outwardly from the two opposite edges and which are pivoted respectively to the toothed cutting plates of the pan. A toothed cutting plate is formed integrally with the base wall of the cover and has two ends connected to the two flanges.

The toilet-paper holder further includes locking means for locking the cover against the pan. The locking means has a key-operated lock member fixed to the pan and a latch member fixed to the cover to engage the key-operated lock member.

The stationary shaft may be formed with a circumferential groove on an outer wall thereof. The sleeve member may have a plurality of protrusions projecting from an inner surface thereof to engage slidably the circumferential groove of the stationary shaft in order to prevent axial movement of the sleeve member relative to the stationary shaft.

The stationary shaft may be mounted with a biasing means adjacent to the second end thereof in order to bias the rotary knob outwards via the sleeve member. The biasing means has a push member mounted movably to the second end of the stationary shaft and a compression spring mounted in the stationary shaft in order to bias the push member outwards.

The base wall of the cover may have a recessed area in order to retain rotatably the rotary knob therein. The recessed area is formed with a hole through which the rotary knob extends inwardly of the cover.

The rotary knob may have a body passing slidably through the hole and in sliding contact with an edge confining the hole. The body has an outer end, an inner end opposite to the outer end, and an annular flange projecting radially from the outer end and to be retained rotatably in the recessed area. The rotary knob has a plurality of resilient engaging elements mounted axially on the body in order to engage the edge confining the hole when the rotary knob is placed in the releasing position, a plurality of radially extending ribs formed on the inner end to engage the clutch teeth of the sleeve member when the rotary knob is placed in the engaging position, and an axially projecting stem in contact with the push member of the biasing means.

BRIEF DESCRIPTION OF THE DRAWINGS

Other features and advantages of the present invention will become apparent in the following detailed description of the preferred embodiment, with reference to the accompanying drawings, in which.

DETAILED DESCRIPTION OF THE PREFERRED EMBODIMENT

Figure 1:
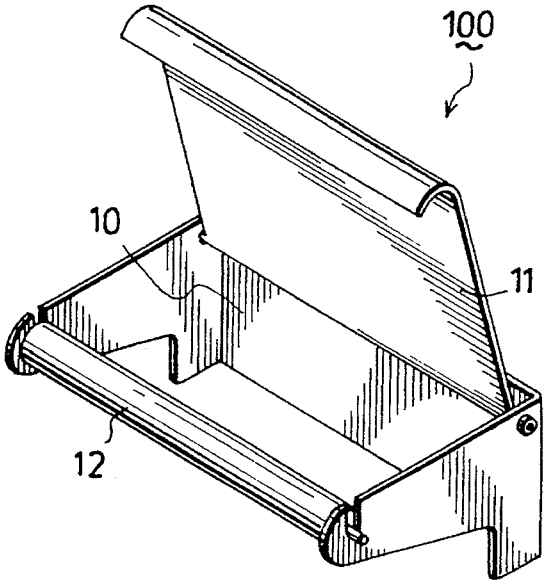
FIG. 1 PRIOR ART
FIG. 1 is a schematic view of a first example of a conventional toilet-paper holder.
Figure 2:
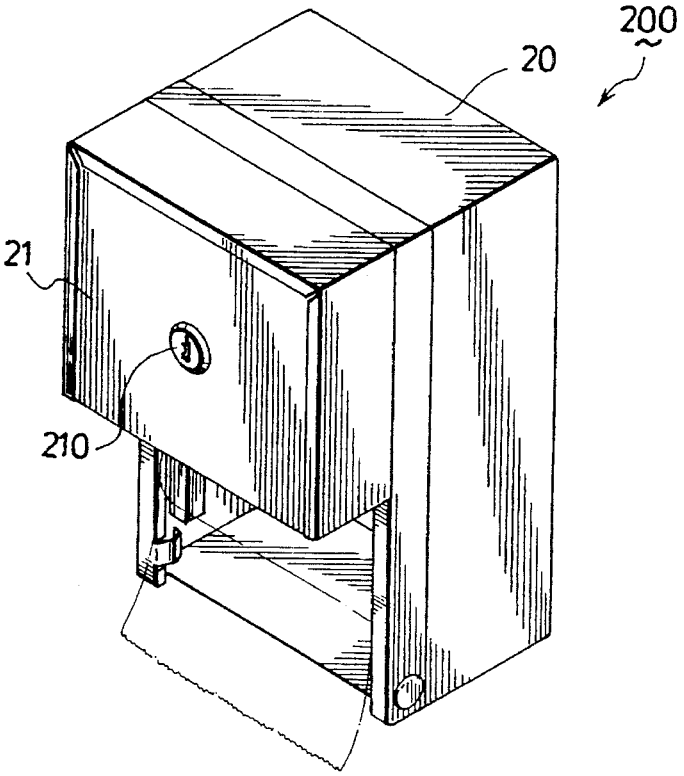
FIG. 2 PRIOR ART
FIG. 2 is a schematic view of a second example of a conventional toilet-paper holder.

Referring to FIGS. 3 to 10, a toilet-paper holder (TH) of this invention has a casing (Cl) with a pan 30. The pan 30 has a base (30*a*), a peripheral wall (30*b*) extending from the base (30*a*) and an open end. The peripheral wall (30*b*) has an exit opening 35, two opposite edges (B, C) which define the exit opening 35, and two toothed cutting plates 350 which extend downwards and outwards from the opposite edges (B, C), respectively.

The casing (C1) further includes a cover 40 which is pivoted to the pan 30 and which covers openably the open end of the pan 30. The cover 40 has a base wall (40*a*) opposite to the base (30*a*) of the pan 30 and a peripheral wall (40*b*) extending from the base wall (40*a*) so as to be coupled detachably with the peripheral wall (30*b*) of the pan 30. The peripheral wall (40*b*) has an exit opening 43 aligned with the exit opening 35 of the peripheral wall (30*b*) of the pan 30, two opposite edges which define the exit opening 43, and two flanges (E, F) which extend downwards from the respective one of the opposite edges. A toothed cutting plate 430 is formed integrally with the base wall (40*a*) and has two ends connected to the two flanges (E, F). The flanges (E, F) are pivoted to the toothed cutting plates 350 of the pan 30 by means of pivot pins 44 which pass through holes 351 in the toothed cutting plates 350 and holes 431 in the flanges (E, F). The base wall (40*a*) has a recessed area (41*a*) formed with a hole 41.

Figure 3:
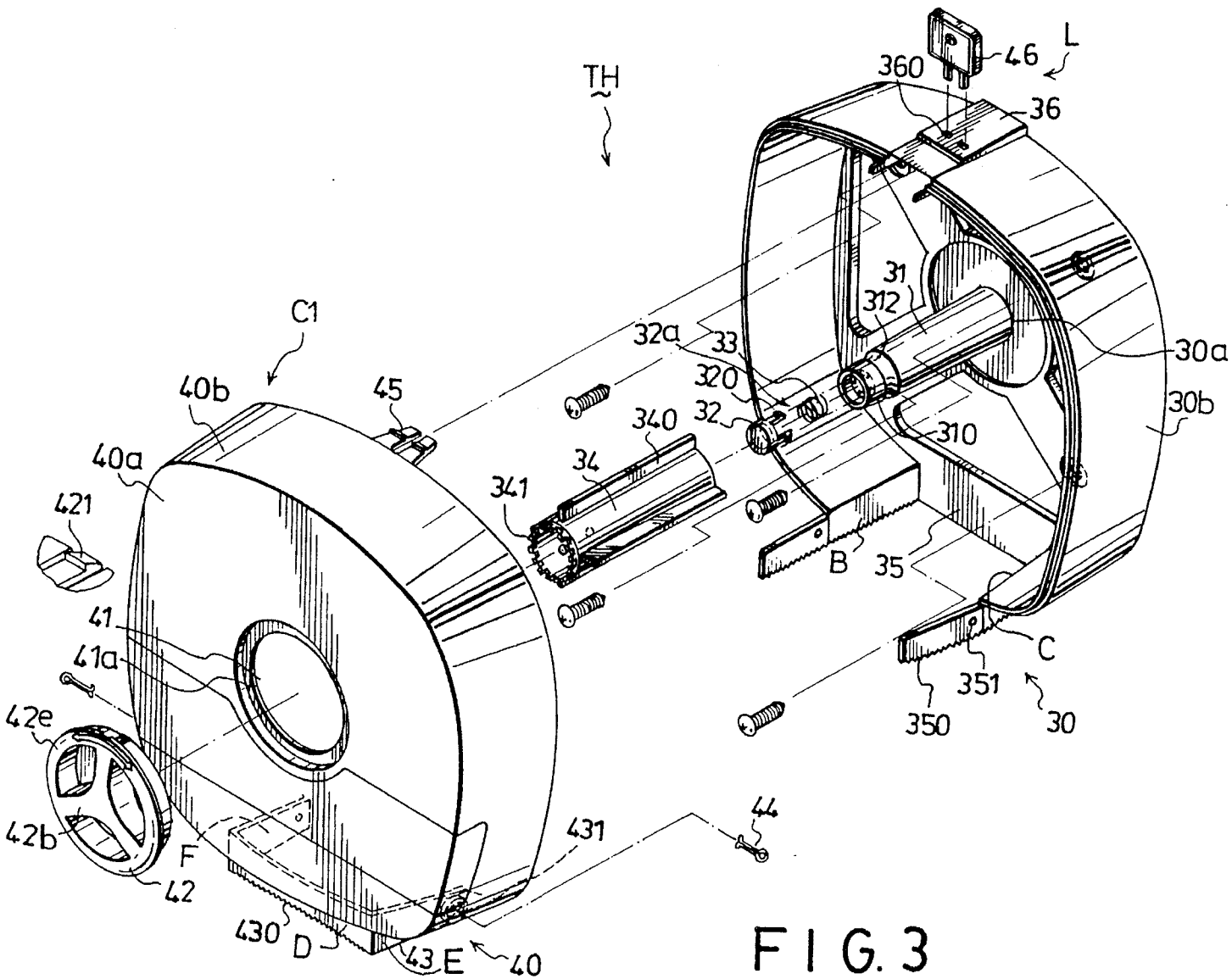
FIG. 3 is an exploded view of a toilet-paper holder of this invention.
Figure 4:
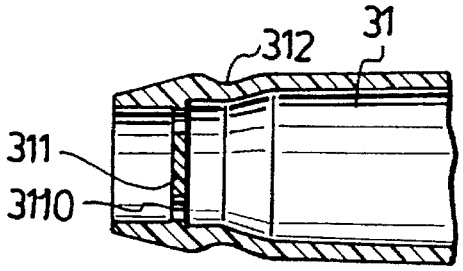
FIG. 4 is a partially sectional view of a stationary shaft of the toilet-paper holder of this invention.
Figure 5:
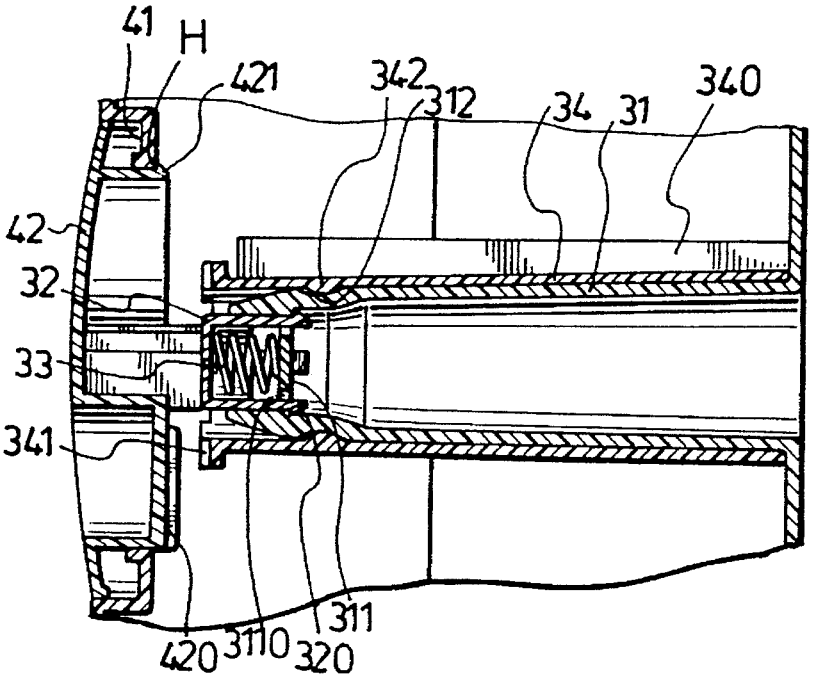
FIG. 5 is a sectional view of the toilet-paper holder of this invention showing a rotary knob of the latter when placed in a releasing position.
Figure 6:
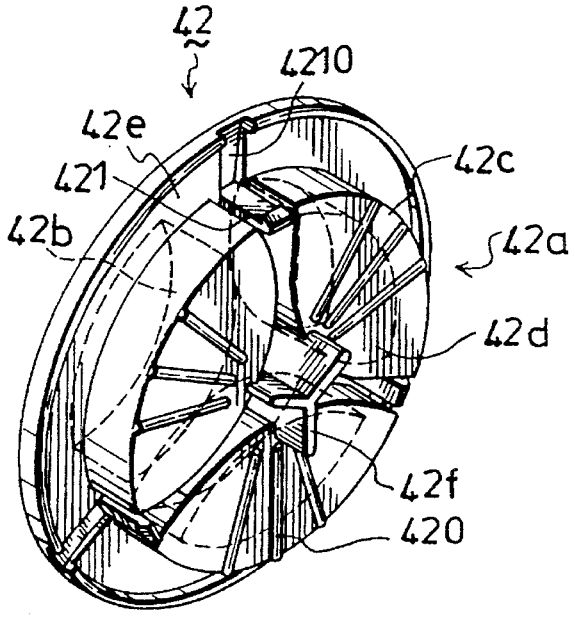
FIG. 6 is a perspective view of the rotary knob of the toilet-paper holder of this invention.

A stationary shaft 31 is provided in the casing (C1) and has a first end which is fixed to the base (30*a*) of the pan 30 and a second end which extends toward the base wall (40*a*) of the cover 40 and which is an open end. Referring to FIGS. 3 to 5, the stationary shaft 31 is formed with a circumferential groove 312 on an outer wall thereof adjacent to the second end, and has a perforated engaging plate 311 formed therein. A biasing means (32*a*) includes a push member 32 mounted movably to the second end of the stationary shaft 31 by means of a plurality of resilient barb members 320 which engage holes 3110 in the perforated engaging plate 311. The biasing means (32*a*) further includes a compression spring 33 retained bet ween the perforated engaging plate 311 and the pushing member 32 in order to bias the push member 32 outwards.

A sleeve member 34 for holding frictionally a toilet-paper roll (not shown) thereon is mounted coaxially and rotatably to the stationary shaft 31 and has an end which extends toward the base wall (40*a*) of the cover 40 and which is formed with angularly spaced and axially projecting clutch teeth 341. The sleeve member 34 has four spaced elongated ribs 340 projecting outwardly from an outer surface thereof and two opposite protrusions 342 projecting radially from an inner surface thereof to engage slidably the circumferential groove 312 of the stationary shaft 31 in order to prevent axial movement of the sleeve member 34 relative to the stationary shaft 31.

Referring to FIGS. 3, 5, 6 and 10, a rotary knob 42 is mounted rotatably in the recessed area (41*a*) of the base wall (40*a*) of the cover 40 and is movable axially between an engaging position and a releasing position. The rotary knob 42 has a body (42*a*) passing slidably through the hole 41 in the recessed area (41*a*) and being in sliding contact with an edge (H) that confines the hole 41. The body (42*a*) has a circular cross-section, an outer end (42*b*) and an inner end (42*c*) opposite to the outer end (42*b*). The body (42*a*) includes three spaced hollow parts (42*d*), each of which closes at the inner end (42*c*) and opens at the outer end (42*b*), and an annular flange (42*e*) which projects radially from the outer end (42*b*) in order to be retained movably in the recessed area (41a). The rotary knob 42 further has a plurality of radially extending ribs 420 formed on the inner end (42*c*) so as to engage the clutch teeth 341 of the sleeve member 34 when the rotary knob 42 is moved inwardly to be placed in the engaging position, an axially projecting stem (42*f*) which extends inwardly in the space defined among the three hollow parts (42*d*) so as to be in contact with the push member 32 of the biasing means (32*a*), and three L-shaped resilient engaging elements 4210. Each L-shaped resilient engaging element 4210 has a fixed portion secured to the annular flange (42*e*) and a resilient barb portion 421 which extends in the clearance between the hollow parts (42*d*) in order to engage the edge (H) when the rotary knob 42 is moved outwardly so as to be placed in the release position to prevent detachment of the rotary knob 42 from the recessed area (41*a*).

Referring again to FIGS. 3, 8 and 9, the toilet-paper holder (TH) has a locking means (L) to lock the cover 40 against the pan 30. The locking means (L) has a key-operated lock member 36 fixed to the peripheral wall (30*b*) of the pan 30, a latch member 45 fixed to the peripheral wall (40*b*) to engage the key-operated lock member 36, and a key 46.

Figure 7:
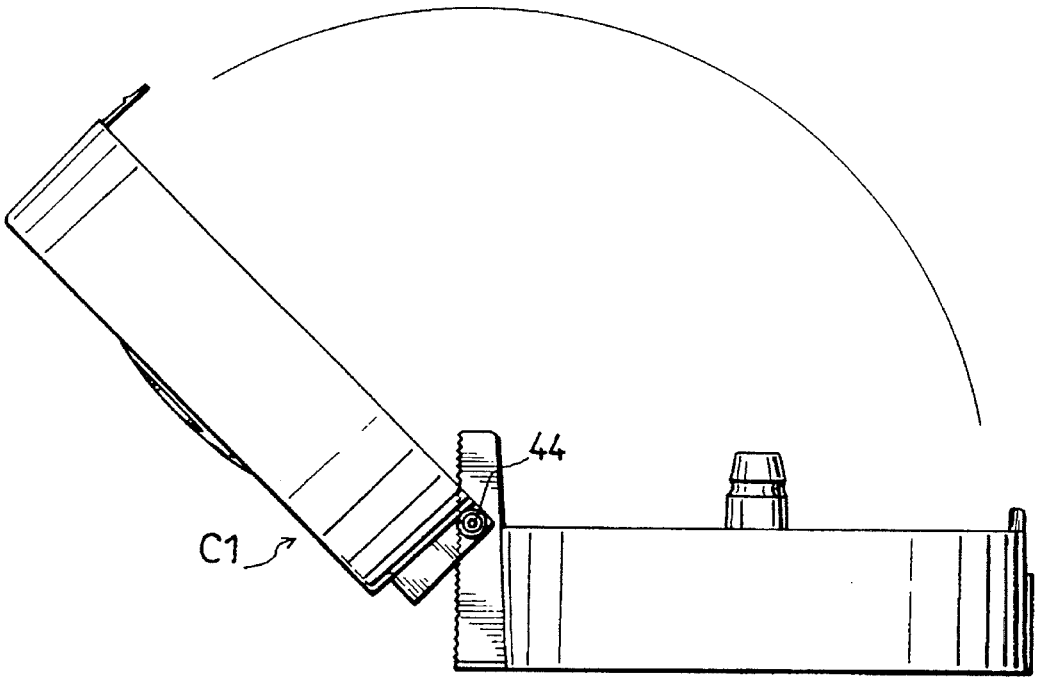
FIG. 7 is a schematic view showing a cover of the toilet-paper holder when pivoted relative to a pan.
Figure 8:
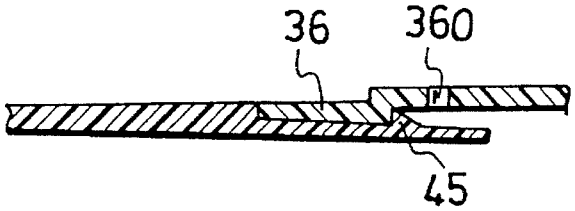
FIG. 8 is a sectional view showing a latch member of the toilet-paper holder when engaging a key-operated lock member.
Figure 9:
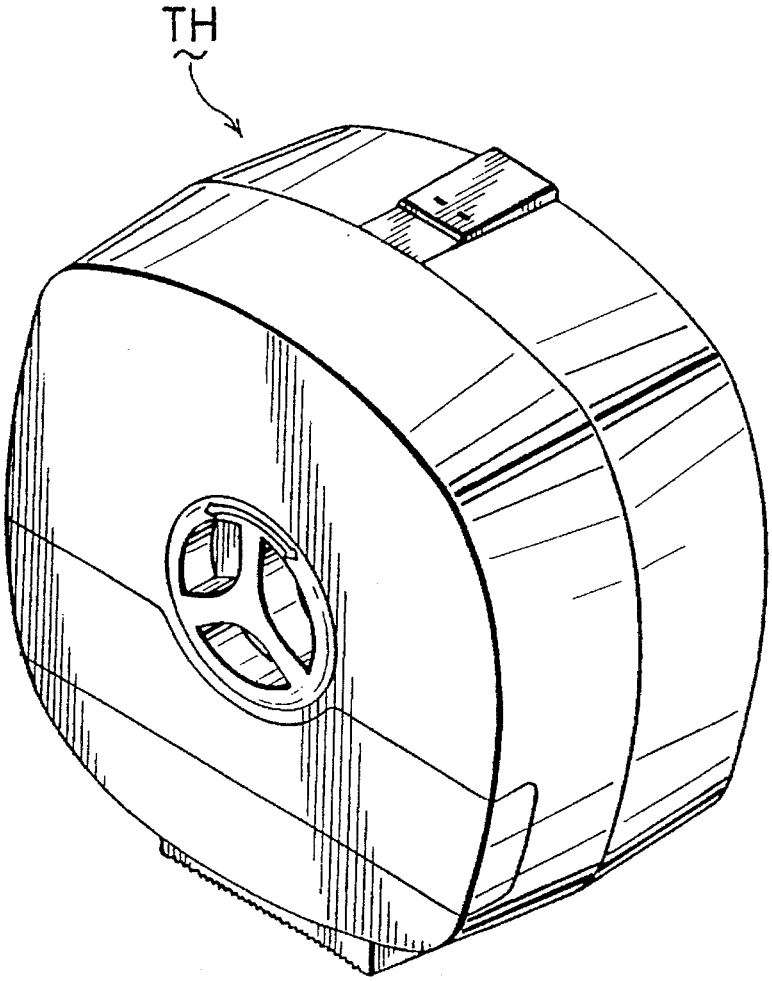
FIG. 9 is an assembled view of the toilet-paper holder shown in FIG. 3.

Referring to FIGS. 7 to 9, the toilet-paper roll (not shown) can be sleeved frictionally around the sleeve member 34 in order to rotate therewith when the casing (Cl) is opened by means of the key 46 which is inserted into hole 360 in the key-operated lock member 36 to release the latch member 45 from the lock member 36.

Figure 10:
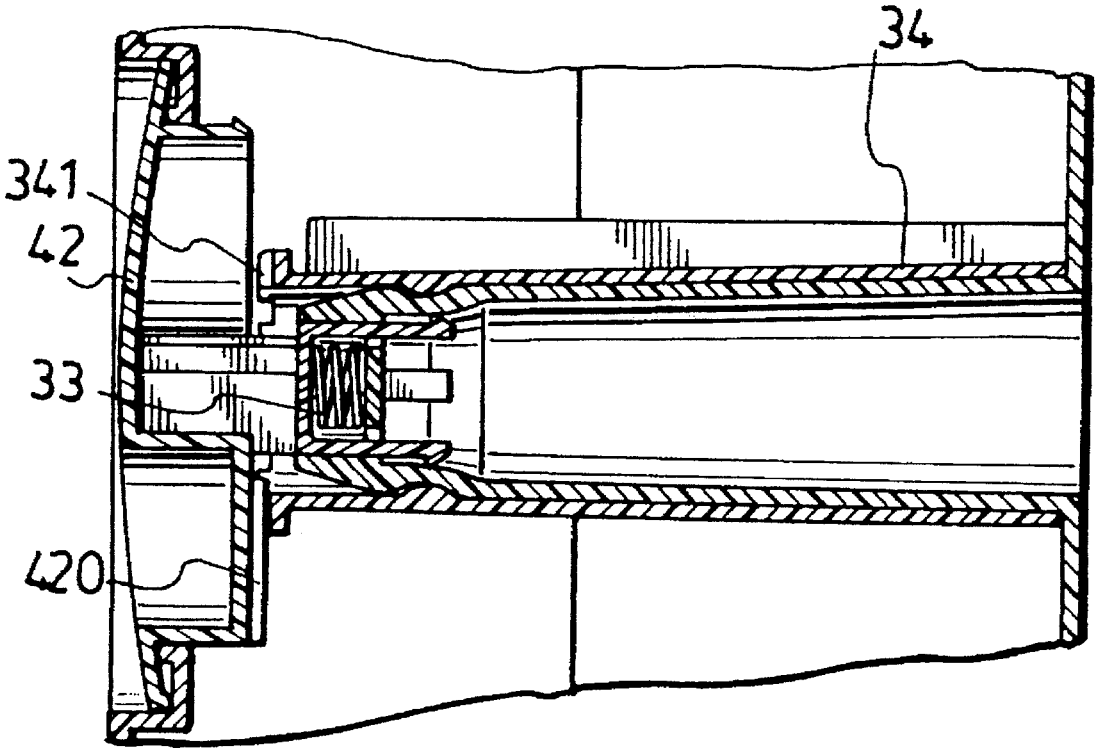
FIG. 10 is a sectional view of the toilet-paper of this invention showing the rotary knob when placed in an engaging position.

When the rotary knob 42 is moved outwardly so as to be placed in the releasing position, as shown in FIG. 5, the radially extending ribs 420 detach from the clutch teeth 341, the compression spring 33 biases the push member 32 to press the axially projecting stem (42*f*) outwards via the end of the sleeve member 34, and the resilient barb portions 421 engage the edge (H) so as to maintain rotatably the rotary knob 42 in the recessed area (41*a*). The user can take easily a predetermined length of paper via the exit openings 35, 43 by pulling a distal end of the toilet-paper roll outwards and can cut the paper by the use of the toothed cutting plates 350, 430. When the rotary knob 42 is pressed inwardly so as to be placed in the engaging position, as shown in FIG. 10, the radially extending ribs 420 engage the clutch teeth 341 in order to rotate the sleeve member 34 in a first direction, so as to unreel the paper, or in a second direction so as to reel the paper. Thus, according to the present invention, in the event that the distal end of the toilet-paper roll is concealed in the casing (C1), the paper can still be easily extended from the casing (C1) by simply operating the rotary knob 42 to rotate the sleeve member 34 in the first direction. In addition, the paper can be easily and conveniently reeled backwards when an undesired excess length of paper is released by simply operating the rotary knob 42 to rotate the sleeve member 34 in the second direction. It is noted that since the casing (C1) can be locked, the toilet-paper roll received therein can be prevented from being stolen.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A toilet-paper holder comprising:

a casing including a pan, which has a base, a peripheral wall extending from said base and an open end, and a cover which is pivoted to said pan and which covers openably said open end of said pan, said peripheral wall of said pan having an exit opening, said cover having a base wall opposite to said base of said pan;

a stationary shaft provided in said casing and having a first end fixed to said base of said pan and a second end extending toward said base wall of said cover, said stationary shaft formed with a circumferential groove on an outer wall thereof;

a sleeve member mounted coaxially and rotatably to said stationary shaft and having an end extending toward said base wall of said cover, said sleeve member having a plurality of protrusions projecting from an inner surface thereof to engage slidably said circumferential groove of said stationary shaft in order to prevent axial movement of said sleeve member relative to said stationary shaft, said end of said sleeve member being formed with angularly spaced and axially projecting clutch teeth; and a rotary knob mounted movably on said base wall of said cover and being operable so as to rotate said sleeve member, said rotary knob extending inwardly of said cover and being movable axially between an engaging position, wherein said rotary knob engages releasably said end of said sleeve member in order to rotate said sleeve member, and a releasing position, wherein said rotary knob is released from said end of said sleeve member in order to permit free rotation of said sleeve member, said rotary knob having a plurality of radially extending ribs formed on an inner end thereof to engage said clutch teeth of said sleeve member when said rotary knob is placed in said engaging position.

2. A toilet-paper holder as claimed in claim 1, wherein said peripheral wall of said pan has two opposite edges which define said exit opening and two toothed cutting plates which are mounted respectively to said two opposite edges.

3. A toilet-paper holder as claimed in claim 2, wherein said cover has a peripheral wall extending from said base wall to be coupled detachably with said peripheral wall of said pan, said peripheral wall of said cover having an exit opening aligned with said exit opening of said peripheral wall of said pan, said peripheral wall of said cover having two opposite edges defining said exit opening of said cover and two flanges extending outwardly from said two opposite edges and being pivoted respectively to said toothed cutting plates of said pan, a toothed cutting plate being formed integrally with said base wall of said cover and having two ends connected to said two flanges.

4. A toilet-paper holder as claimed in claim 1, further comprising means for locking said cover against said pan, said locking means having a key-operated lock member fixed to said pan and a latch member fixed to said cover to engage said key-operated lock member.

5. A toilet-paper holder as claimed in claim 1, wherein said stationary shaft is mounted with a biasing means adjacent to said second end thereof in order to bias said rotary knob outwards via said end of said sleeve member.

6. A toilet-paper holder as claimed in claim 5, wherein said biasing means has a push member mounted movably to said second end of said stationary shaft and a compression spring mounted in said stationary shaft in order to bias said push member outwards.

7. A toilet-paper holder as claimed in claim 6, wherein said base wall of said cover has a recessed area to retain rotatably said rotary knob therein, said recessed area being formed with a hole through which said rotary knob extends inwardly of said cover.

8. A toilet-paper holder as claimed in claim 7, wherein said rotary knob has a body passing slidably through said hole and in sliding contact with an edge confining said hole, said body including said inner end of the knob, an outer end opposite to said inner end and an annular flange projecting radially from said outer end so as to be retained rotatably in said recessed area, said rotary knob having a plurality of resilient engaging elements mounted axially on said body in order to engage said edge confining said hole when said rotary knob is placed in said releasing position, and an axially projecting stem in contact with said push member of said biasing means.

9. A toilet-paper holder comprising:

a casing including a pan, which has a base, a peripheral wall extending from said base and an open end, and a cover which is pivoted to said pan and which covers openably said open end of said pan, said peripheral wall of said pan having an exit opening, said cover having a base wall opposite to said base of said pan;

a stationary shaft provided in said casing and having a first end fixed to said base of said pan and a second end extending toward said base wall of said cover, said stationary shaft formed with a circumferential groove on an outer wall thereof;

a sleeve member mounted coaxially and rotatably to said stationary shaft and having an end extending toward said base wall of said cover, said sleeve member having a plurality of protrusions projecting from an inner surface thereof to engage slidably said circumferential groove of said stationary shaft in order to prevent axial movement of said sleeve member relative to said stationary shaft, said end of said sleeve member being formed with angularly spaced and axially projecting clutch teeth; and a rotary knob mounted movably on said base wall of said cover and being operable so as to rotate said sleeve member, said rotary knob extending inwardly of said cover and being movable axially between an engaging position, wherein said rotary knob engages releasably said end of said sleeve member in order to rotate said sleeve member, and a releasing position, wherein said rotary knob is released from said end of said sleeve member in order to permit free rotation of said sleeve member, said rotary knob having a plurality of radially extending ribs formed on an inner end thereof in order to engage said clutch teeth of said sleeve member when said rotary knob is placed in said engaging position, and an axially projecting stem;

wherein said stationary shaft is mounted with a biasing means adjacent to said second end thereof in order to bias said rotary knob outwards via said end of said sleeve member, said biasing means having a push member mounted movably to said second end of said stationary shaft and a compression spring mounted in said stationary shaft in order to bias outwards said push member in contact with the axially projecting stem of said rotary knob.

10. A toilet-paper holder as claimed in claim 9, wherein said base wall of said cover has a recessed area to retain rotatably said rotary knob therein, said recessed area being formed with a hole through which said rotary knob extends inwardly of said cover.

11. A toilet-paper holder as claimed in claim 10, wherein said rotary knob has a body passing slidably through said hole and in sliding contact with an edge confining said hole, said body including said inner end of the knob, an outer end opposite to said inner end and an annular flange projecting radially from said outer end so as to be retained rotatably in said recessed area, said rotary knob having a plurality of resilient engaging elements mounted axially on said body in order to engage said edge confining said hole when said rotary knob is placed in said releasing position.

12. A toilet-paper holder as claimed in claim 9, wherein said peripheral wall of said pan has two opposite edges which define said exit opening and two toothed cutting plates which are mounted respectively to said two opposite edges.

13. A toilet-paper holder as claimed in claim 12, wherein said cover has a peripheral wall extending from said base wall to be coupled detachably with said peripheral wall of said pan, said peripheral wall of said cover having an exit opening aligned with said exit opening of said peripheral wall of said pan, said peripheral wall of said cover having two opposite edges defining said exit opening of said cover and two flanges extending outwardly from said two opposite edges and being pivoted respectively to said toothed cutting plates of said pan, a toothed cutting plate being formed integrally with said base wall of said cover and having two ends connected to said two flanges.

14. A toilet-paper holder as claimed in claim 9, further comprising means for locking said cover against said pan, said locking means having a key-operated lock member fixed to said pan and a latch member fixed to said cover to engage said key-operated lock member.

15. A toilet-paper holder comprising:

a casing including a pan, which has a base, a peripheral wall extending from said base and an open end, and a cover which is pivoted to said pan and which covers openably said open end of said pan, said peripheral wall of said pan having an exit opening, said cover having a base wall opposite to said base of said pan;

a stationary shaft provided in said casing and having a first end fixed to said base of said pan and a second end extending toward said base wall of said cover, said stationary shaft formed with a circumferential groove on an outer wall thereof;

a sleeve member mounted coaxially and rotatably to said stationary shaft and having an end extending toward said base wall of said cover, said sleeve member having a plurality of protrusions projecting from an inner surface thereof to engage slidably said circumferential groove of said stationary shaft in order to prevent axial movement of said sleeve member relative to said stationary shaft, said end of said sleeve member formed with angularly spaced and axially projecting clutch teeth; and a rotary knob mounted movably on said base wall of said cover and being operable so as to rotate said sleeve member, said rotary knob extending inwardly of said cover and being movable axially between an engaging position, wherein said rotary knob engages releasably said end of said sleeve member in order to rotate said sleeve member, and a releasing position, wherein said rotary knob is released from said end of said sleeve member in order to permit free rotation of said sleeve member, said rotary knob having a plurality of resilient engaging elements mounted axially on said knob in order to engage a hole formed on said cover when said rotary knob is placed in said releasing position, a plurality of radially extending ribs formed on an inner end of the knob in order to engage said clutch teeth of said sleeve member when said rotary knob is placed in said engaging position, and an axially projecting stem, wherein said stationary shaft is mounted with a biasing means adjacent to said second end thereof in order to bias said rotary knob outwards via said end of said sleeve member, said biasing means having a push member mounted movably to said second end of said stationary shaft and a compression spring mounted in said stationary shaft in order to bias outwards said push member in contact with the axially projecting stem.

16. A toilet-paper holder as claimed in claim 15, wherein said base wall of said cover has a recessed area to retain rotatably said rotary knob therein, said recessed area being formed with said hole through which said rotary knob extends inwardly of said cover.

17. A toilet-paper holder as claimed in claim 16, wherein said rotary knob has a body passing slidably through said hole and in sliding contact with an edge confining said hole, said body including said inner end, an outer end opposite to said inner end and an annular flange projecting radially from said outer end so as to be retained rotatably in said recessed area.

* * * * *